US006670591B2

(12) United States Patent
Shon et al.

(10) Patent No.: US 6,670,591 B2
(45) Date of Patent: Dec. 30, 2003

(54) MICROWAVE OVEN

(75) Inventors: Jong-Chull Shon, Suwon (KR); Won-Woo Lee, Suwon (KR); So-Hyun Lee, Suwon (KR); Keun-Seuk Oh, Suwon (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 10/261,597

(22) Filed: Oct. 2, 2002

(65) Prior Publication Data

US 2003/0192885 A1 Oct. 16, 2003

(30) Foreign Application Priority Data

Apr. 13, 2002 (KR) ..... 2002-20269

(51) Int. Cl.[7] ..... H05B 6/68

(52) U.S. Cl. ..... 219/707; 219/719; 219/492; 99/325

(58) Field of Search ..... 219/707, 719, 219/705, 708, 702, 492; 99/325, 451, DIG. 14

(56) References Cited

U.S. PATENT DOCUMENTS 4,864,088 A * 9/1989 Hiejima et al. ..... 219/707
4,874,928 A * 10/1989 Kasai ..... 219/492
5,367,145 A * 11/1994 Takagi ..... 219/719
5,545,881 A * 8/1996 Chai et al. ..... 219/719
6,252,213 B1 6/2001 Kang ..... 219/702

FOREIGN PATENT DOCUMENTS

JP 1-217129 * 8/1989 ..... 219/707

* cited by examiner

*Primary Examiner*—Philip H. Leung
(74) *Attorney, Agent, or Firm*—Staas & Halsey LLP

(57) ABSTRACT

A microwave oven performs a cooking operation in one of several cooking modes having a first cooking time period and a second cooking time period. The first cooking time period is determined in accordance with an output value of a sensor which senses a state of air in a cooking cavity of the microwave oven. The second cooking time period is determined in accordance with the first cooking time period such that the first and second cooking time periods are expressed by a functional relation. The cooking modes include a standard mode with a standard second cooking time period, a high mode with a longer cooking time than the standard second cooking time period, and a low mode with a shorter cooking time than the standard second cooking time period. The high mode is preset such that a variation in its second cooking time period is increased in proportion to the first cooking time period, while the low mode is preset such that a variation in its second cooking time period is increased in inverse proportion to the first cooking time period. The microwave oven allows a user to set a cooking time period such that the cooking time period is controllably lengthened or shortened in proportion to the quantity of food contained in the microwave oven.

20 Claims, 8 Drawing Sheets

MICROWAVE OVEN

CROSS-REFERENCE TO RELATED APPLICATIONS

This application claims the benefit of Korean Patent Application No. 2002-20269 filed on Apr. 13, 2002, in the Korean Industrial Property Office, the disclosure of which is incorporated herein by reference.

BACKGROUND OF THE INVENTION

1. Field of the Invention

The present invention relates to microwave ovens, and more particularly, to a microwave oven which controls a variation in a cooking time period in accordance and proportionally with the quantity of food being cooked.

2. Description of the Related Art

Generally, microwave ovens are machines which cook food with the assistance of a variety of atmospheric sensors, such as a humidity sensor, a temperature sensor and a gas sensor, in addition to a weight sensor which measures the weight of the food to be cooked. A conventional cooking operation of such a microwave oven is described below.

To initiate a cooking operation, a user operates a start button of the microwave oven after laying the food on a turntable-type cooking tray installed in a cooking cavity of the microwave oven, and selecting a desired cooking mode in an automatic cooking menu provided on a control panel of the microwave oven. Thereafter, a microprocessor of the microwave oven receives a signal output from a humidity sensor of the microwave oven, and compares the signal output from the humidity sensor with preset reference data stored in a data storage unit of the microwave oven. Then, the microwave oven calculates a target cooking time period so as to control a magnetron of the microwave oven in accordance with the calculated target cooking time period.

In a conventional method of controlling the microwave oven, a first cooking time period is determined such that it is terminated at a time when a calculated slope of a sensor output value becomes equal to a preset reference slope. A second cooking time period is determined in accordance with the first cooking time period and factors preset in accordance with the kind of food to be cooked. When the second cooking time period expires, the total time period of the cooking operation ends.

In the conventional method, current atmospheric conditions obtained from signals output from the humidity sensor, temperature sensor and gas sensor during the cooking operation are different from previous atmospheric conditions. Therefore, the slope of a sensor output curve varies, and it is difficult for the microprocessor of the microwave oven to determine a precise first cooking time period. As such, it is necessary in the conventional method of controlling the microwave oven to provide an initial standby time period of, for example, about 20 minutes, before starting the magnetron of the microwave oven in a new cooking operation. During such an initial standby time period, the magnetron is stopped, and a fan installed in a machine room of the microwave oven is operated to reduce the temperature in the cooking cavity to near a predetermined point.

FIG. 1 shows a graph expressing a conventional method of controlling a cooking operation of the microwave oven described above. As shown in the graph, the method includes sectioning a total cooking time period into an initial standby time period TC, a first cooking time period T1, and a second cooking time period T2. That is, at an initial stage of the cooking operation, in a selected cooking mode, the temperature in a cooking cavity is reduced to near a predetermined point during the initial standby time period TC of, for example, about 20 minutes. The first cooking time period T1 starts at a time when the initial standby time period TC ends, and is terminated when a calculated slope of a sensor output value becomes equal to a preset reference slope "A."

The first cooking time period T1 is determined in accordance with the quantity of food to be cooked. In such a case, measuring of the quantity of the food may be directly performed using a weight sensor. However, to avoid the use of expensive weight sensors in the microwave ovens, the measuring of the quantity of the food may be performed through an indirect method using an inexpensive humidity sensor. That is, the microprocessor of the microwave oven may measure humidity or the amount of moisture, i.e., in a form of steam, laden in air generated and discharged from the cooking cavity, and determine the quantity of food from the measured humidity.

To allow the microprocessor to determine the first cooking time period during the cooking operation, reference data of relationships between the amounts of food and humidity of discharged air is experimentally obtained from several cooking operations of specified foods, and stored in a data storage unit. Accordingly, the microprocessor controls the cooking operation of the food using the reference data stored in the data storage unit. Additionally, the first cooking time period T1 is used as a variable when determining the second cooking time period T2. That is, the second cooking time period T2 is determined in accordance with both the first cooking time period T1 and factors preset in accordance with the kind of food to be cooked.

Therefore, when a cooking operation is started, the microprocessor primarily determines a first cooking time period T1 in accordance with the quantity of food to be cooked. After the determination of the first cooking time period T1, the microprocessor determines another time period needed to complete the cooking after a termination of the first cooking time period T1, and sets the determined time period as a second cooking time period T2. In such a case, the determination of the second cooking time period is accomplished by searching the reference data, which is stored in the data storage unit and indicates the relationship between the first and second cooking time periods. When the second cooking time period T2 is completed, the cooking operation is terminated.

In some of the models of the conventional microwave ovens, the transition from the first cooking time period T1 to the second cooking time period T2 is determined in accordance with output values of humidity sensors. Particularly, the above transition is determined by a characteristic curve of a sensor output value indicating sensed humidity (%) of discharged air, as a function of time. In the conventional control method of the microwave ovens, such a reference slope "A" is set by a slope of the characteristic curve at a point where the sensor output value, indicating sensed humidity of discharged air, initially exceeds a preset reference value. The above-mentioned preset reference value is experimentally obtained. That is, the preset reference value is set at a point of the characteristic curve of the sensor output value where the slope of the curve rapidly changes, ideally at a point with a slope of "A."

However, even though the total cooking time period (T1+T2) can be automatically determined using the stored reference data in accordance with the quantity of food as described above, users may want to lengthen or shorten the cooking time periods to cook foods for periods of time which are longer or shorter than the automatically determined cooking time periods. In other words, some users may prefer lesser cooked food rather than medium- or well-done food, and may desire to shorten the cooking time period. On the other hand, others may prefer well-done food rather than the medium- or lesser cooked food, and may want to lengthen the cooking time period.

To allow the users to adjust the cooking time period of a cooking operation, which is different from the automatically determined cooking time period, the conventional microwave oven is provided with a mode-selecting unit through which the users adjust the cooking time period. Accordingly, when a user inputs a desired cooking mode by manipulating the mode-selecting unit, the cooking time period automatically determined in accordance with the quantity of food is lengthened or shortened, so as to cook the food to a user's taste.

FIG. 2 shows a graph illustrating characteristic curves of three types of cooking modes, that is, a high mode 204 with a longer cooking time period, a standard mode 202 with a standard cooking time period, and a low mode 206 with a shorter cooking time period, which are selected by a user through the mode-selecting unit. To cook 100 g of food using a conventional microwave oven, a first cooking time period T1*a* is primarily determined in accordance with the quantity of the food. Thereafter, as shown in the drawing, a second cooking time period T2*a* is determined in accordance with the first cooking time period T1*a*. That is, the standard cooking time period is determined as (T1*a*+T2*a*) by summing the first and second cooking time periods. When a user manipulates the mode-selecting unit to adjust the cooking time period in accordance with his/her taste, the standard cooking time period (T1*a*+T2*a*) for 100 g of food may be lengthened or shortened by Δta.

To cook 300 g of food using the conventional microwave oven, a first cooking time period T1*b* is primarily determined in accordance with the quantity of the food. Thereafter, a second cooking time period T2*b* is determined using the first cooking time period T1*b*. Therefore, the standard cooking time period is determined as (T1*b*+T2*b*) by summing the first and second cooking time periods. When a user manipulates the mode-selecting unit to adjust the cooking time period in accordance with his/her taste, the standard cooking time period (T1*b*+T2*b*) for 300 g of food may be lengthened or shortened by Δtb.

As shown in FIG. 2, the characteristic curve of the high mode 204 is positioned above the characteristic curve of the standard mode 202, and the characteristic curve of the low mode 206 is positioned below the characteristic curve of the standard mode 202. Therefore, it is noted that the total cooking time period in the high mode 204 is longer than that of the standard mode 202, and the total cooking time period in the low mode 206 is shorter than that of the standard mode 202, even though the three modes 202, 204 and 206 have the same first cooking time period T1.

As further shown in FIG. 2, the slopes of the characteristic curves of the three modes 202, 204 and 206, which are determined on the basis of the quantity of food, are equal to each other. Such an equal slope of the characteristic curves of the three modes 202, 204 and 206 is caused by the fact that the second cooking time period T2 of the high mode 204 or the low mode 206 is lengthened or shortened by the same period of time regardless of a variation in the first cooking time period T1 determined on the basis of the quantity of the food. This means that the variations Δta and Δtb in the second cooking time periods T2*a* and T2*b* of the two modes 202 and 204, which are performed in response to a user's input signals transmitted from the mode-selecting unit, are always constant notwithstanding a difference in the quantity of foods to be cooked in cooking operations.

Since the total cooking time periods of the corresponding cooking operations of a conventional microwave oven are lengthened or shortened by the same period of time regardless of a difference in the quantity of foods, for example, 100 g and 300 g, as described above, it is very difficult for a user to prepare the foods of different quantity to his/her desired taste. That is, when a user wants the 100 g food to be well-done, a lengthened cooking time period by 30 seconds may be sufficient for the 100 g of food. But that same additional 30 seconds may not be adequate to prepare well done food for the 300 g of food.

However, since the cooking time periods in the conventional microwave oven are lengthened or shortened by the same time period, regardless of a difference in the quantity of foods, the conventional microwave oven fails to provide a cooking operation suited for an individual's taste.

SUMMARY OF THE INVENTION

Accordingly, it is an object of the present invention to provide a microwave oven which is designed to allow a user to set a cooking time period such that the cooking time period is controllably lengthened or shortened in proportion to the quantity of food to be cooked.

Additional objects and advantages of the invention will be set forth in part in the description which follows and, in part, will be obvious from the description, or may be learned by practice of the invention.

To achieve the above and other objects of the present invention, there is provided a microwave oven which performs a cooking operation in one of cooking modes having a first cooking time period and a second cooking time period, comprising a cooking cavity and a sensor which senses a state of air in the cooking cavity, wherein the first cooking time period is determined in accordance with an output value of the sensor, the second cooking time period is determined in accordance with the first cooking time period such that the first and second cooking time periods are expressed by a functional relation, and the cooking modes include a standard mode in which the second cooking time period is a standard second cooking time period, a high mode in which the second cooking time period is lengthened from the standard second cooking time period, and a low mode in which the second cooking time period is shortened from the standard second cooking time period. The second cooking time period of the high mode is varied to increase in proportion to the first cooking time period, and the second cooking time period of the low mode is varied to increase in inverse proportion to the first cooking time period.

BRIEF DESCRIPTION OF THE DRAWINGS

These and other objects and advantages of the present invention will become apparent and more readily appreciated from the following description of the embodiments, taken in conjunction with the accompanying drawings of which.

DETAILED DESCRIPTION OF THE PREFERRED EMBODIMENTS

Figure 1:
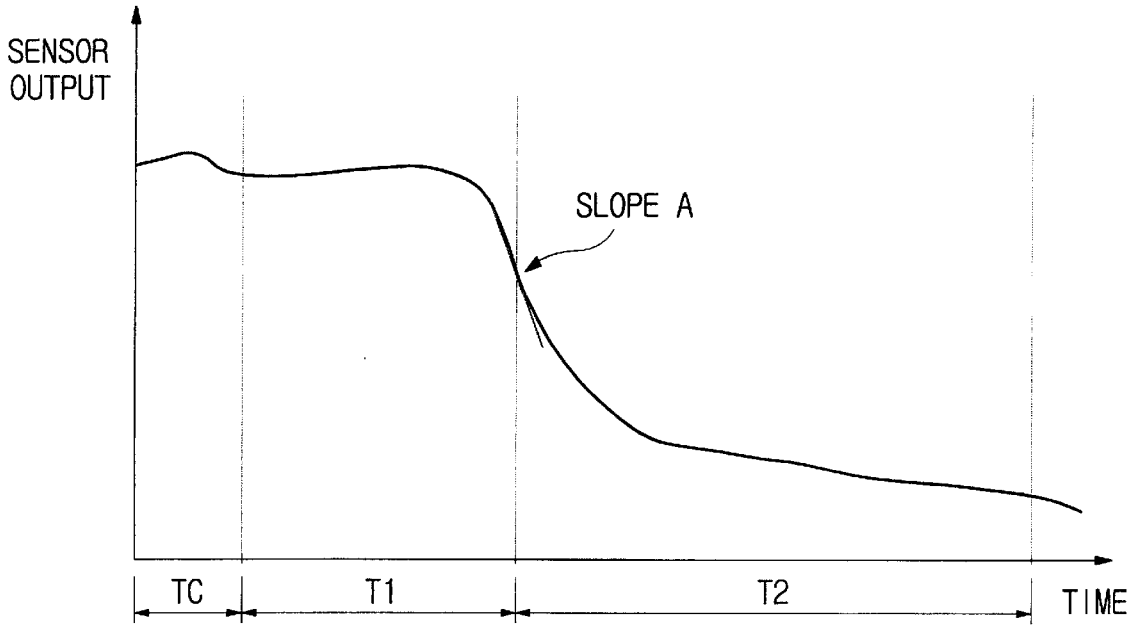
FIG. 1 (PRIOR ART)
FIG. 1 is a graph illustrating a conventional method of controlling a cooking operation of a known microwave oven.
Figure 2:
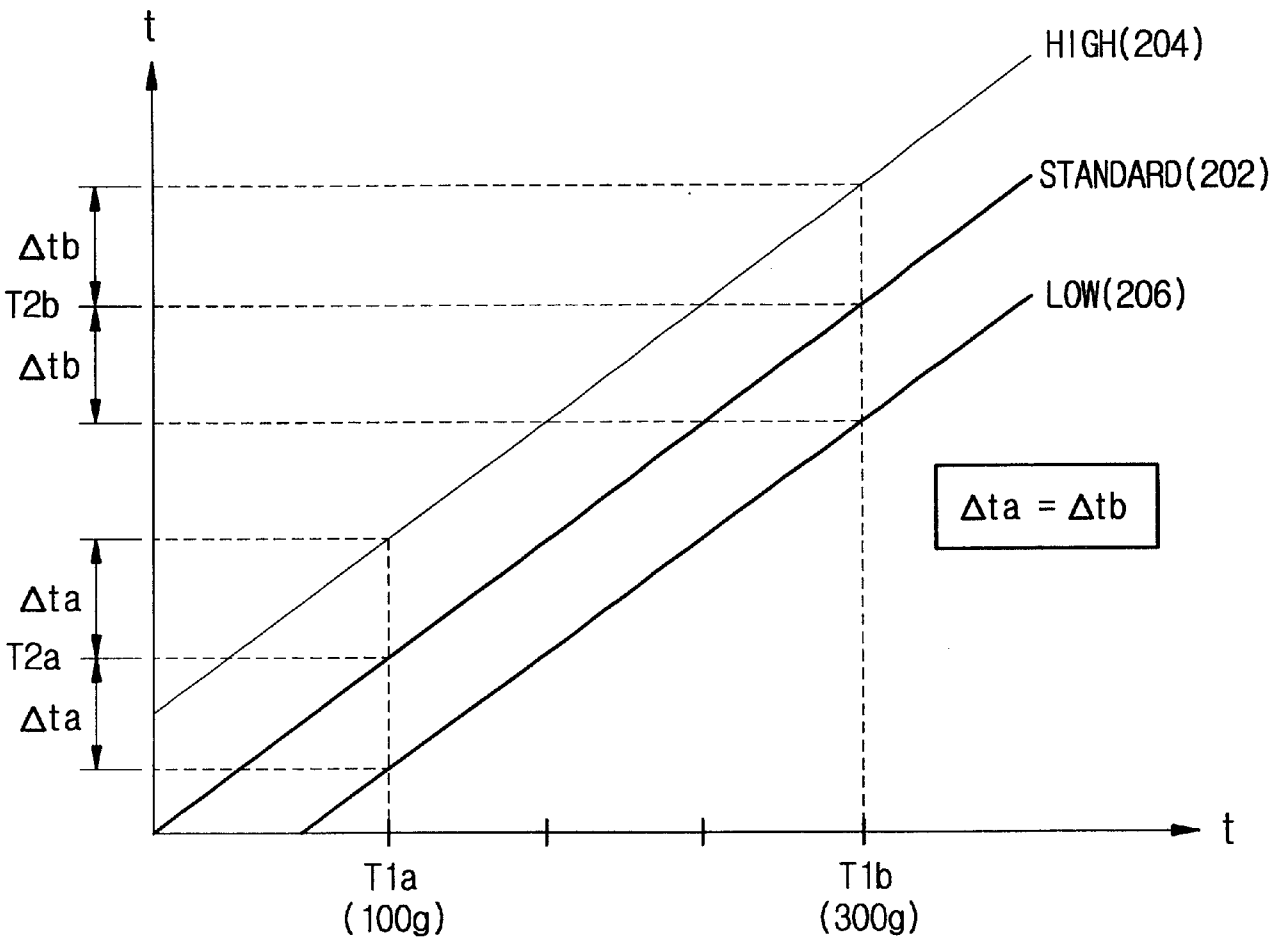
FIG. 2 (PRIOR ART)
FIG. 2 is a graph showing characteristic curves of three types of cooking modes selected by a user through a mode-selecting unit of the known microwave oven.

Reference will now be made in detail to the embodiments of the present invention, examples of which are illustrated in the accompanying drawings, wherein like reference numerals refer to the like elements throughout. The embodiments are described below in order to explain the present invention by referring to the figures.

Figure 3:
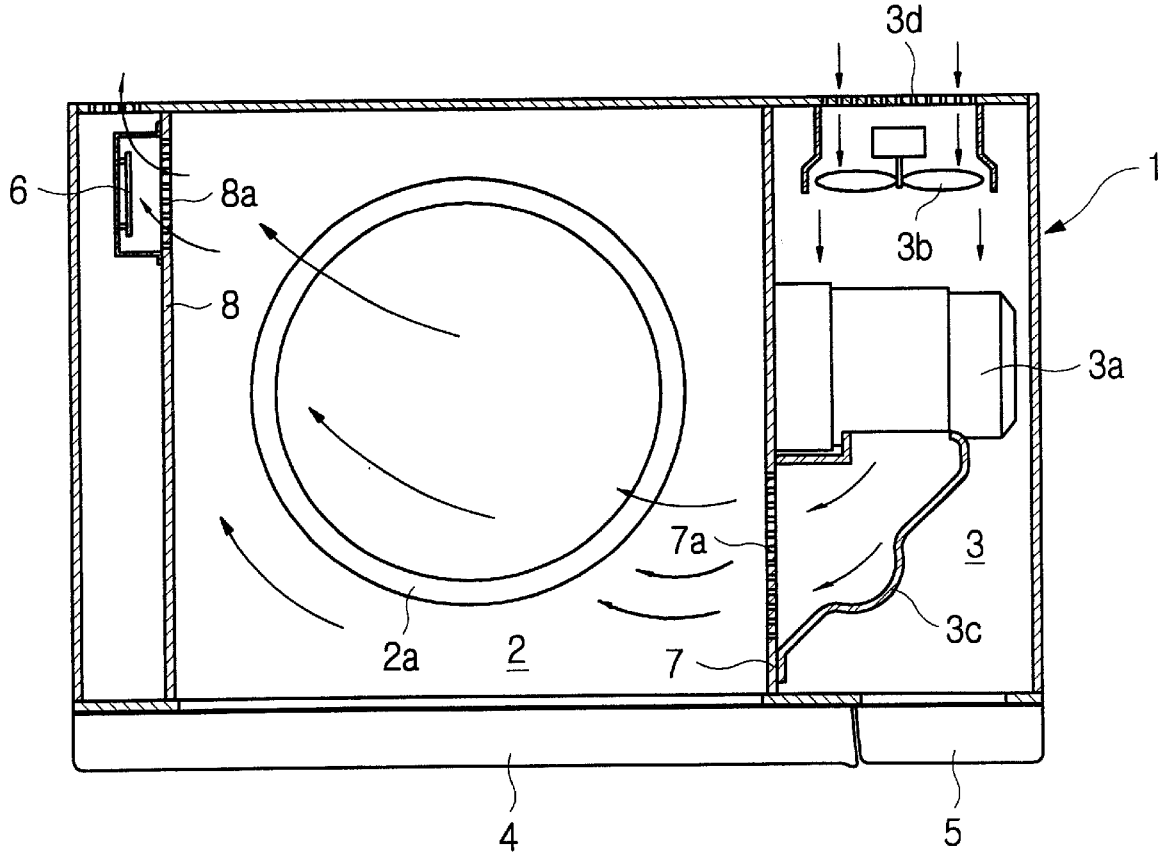
FIG. 3 is a sectional view which illustrates the construction of a microwave oven in accordance with an embodiment of the present invention.

FIG. 3 shows a sectional view of a microwave oven according to an embodiment of the present invention. The microwave oven comprises a body 1 having a cooking cavity 2 and a machine room 3 therein. A door 4 is hinged to the body 1 at a position in front of the cooking cavity 2, and allows a user to open or close the cooking cavity 2. A control panel 5 is provided at a front surface of the body 1. The control panel 5 includes an input unit 5*a* (to be described in detail herein) which has a plurality of control buttons, and a display unit 5*b* (not shown) which displays information thereon during a cooking operation of the microwave oven. A humidity sensor 6 is installed in the body 1 so as to sense a state of air, that is, a moisture content of the air in the cooking cavity 2.

The cooking cavity 2 is opened at its front, and has a turntable-type cooking tray 2*a* arranged on the bottom of the cooking cavity 2. An air inlet port 7*a* is provided at a front portion of a first sidewall 7 of the cooking cavity 2, so as to have the cooking cavity 2 communicate with the machine room 3 through the air inlet port 7*a*. Atmospheric air is thus introduced from the machine room 3 into the cooking cavity 2 through the air inlet port 7*a*. An air outlet port 8*a* is provided at a rear portion of a second sidewall 8 of the cooking cavity 2, and discharges the air from the cooking cavity 2 to the outside of the body 1.

The machine room 3 includes an air guide duct 3*c* and a variety of electrical and electronic devices, for example, a magnetron 3*a* and a cooling fan 3*b*. The magnetron 3*a* generates microwaves, that is, electromagnetic waves having high frequencies. The cooling fan 3*b* sucks atmospheric air into the machine room 3 to cool the electrical and electronic devices installed in the machine room 3. The air guide duct 3*c* guides inlet air to the air inlet port 7*a*. In such a case, the cooling fan 3*b* is installed at a position between a rear wall of the machine room 3 and the magnetron 3*a*. A plurality of air suction holes 3*d* are formed at the rear wall of the machine room 3 so as to guide the atmospheric air into the machine room 3 in response to a suction force generated by operation of the cooking fan 3*b* in the machine room 3.

The humidity sensor 6 is exteriorly mounted on the second sidewall 8 of the cooking cavity 2 at a position facing the air outlet port 8*a*. That is, the humidity sensor 6 is installed at an air path through which the air is discharged from the cooking cavity 2 to the outside of the body 1. Therefore, the humidity sensor 6 can sense the humidity of air discharged from the cooking cavity 2 to the outside through the air outlet port 8*a*. The above humidity sensor 6 is electrically connected to a circuit board (not shown) provided in the control panel 5.

Figure 4:
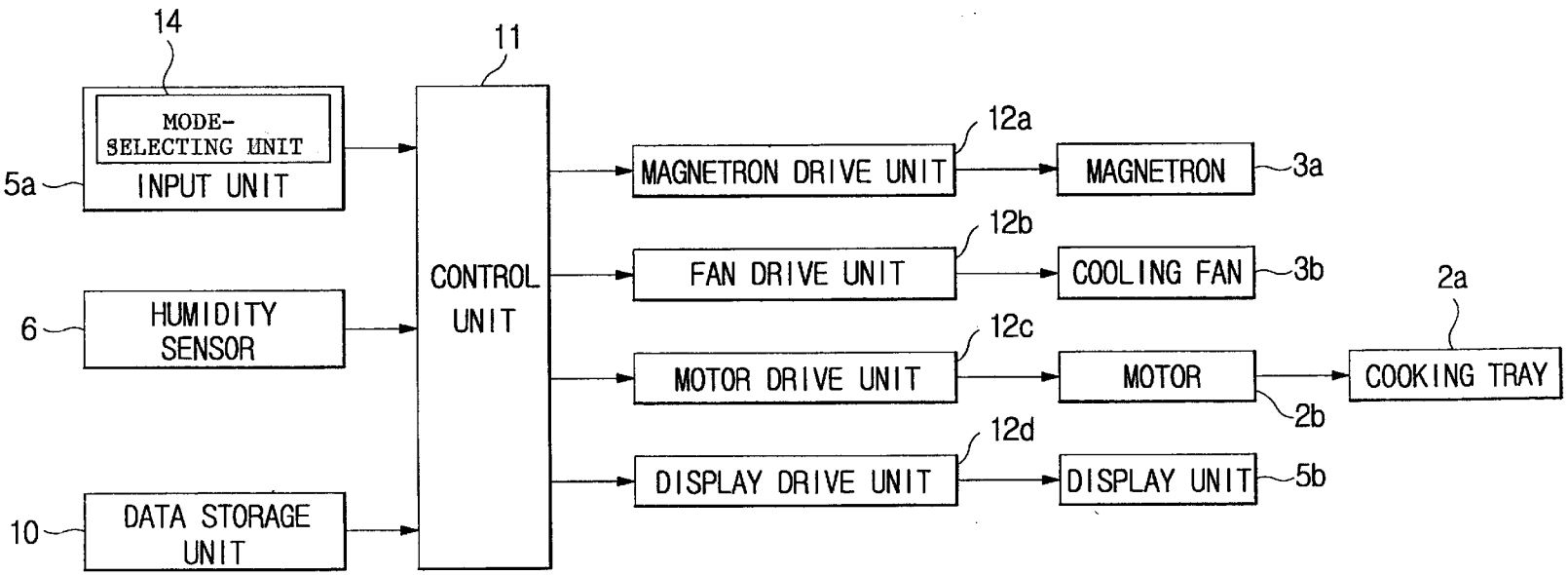
FIG. 4 is a block diagram which illustrates the construction of a control apparatus for controlling an operation of the microwave oven shown in FIG. 3.

FIG. 4 shows a block diagram illustrating the construction of a control apparatus which controls the microwave oven shown in FIG. 3. With reference to FIG. 3, the control apparatus of the present invention comprises a control unit 11 which controls the operation of the microwave oven. The input unit 5*a* provided in the control panel 5 is electrically connected to an input terminal of the control unit 11, and transmits a user's input signals to the control unit 11. The input unit 5*a* includes a mode-selecting unit 14 which is a cooking time control unit that is manipulated by a user to lengthen or shorten a cooking time period as desired. In the microwave oven of the present invention, a data storage unit 10 is provided with data of standard cooking time periods preset to be used in cooking operations for a variety of and different quantities of foods.

A user may manipulate the mode-selecting unit 14 to lengthen or shorten the standard cooking time period so as to prepare the food suited to his/her taste.

The humidity sensor 6 and the data storage unit 10 are electrically connected to corresponding input terminals of the control unit 11. The humidity sensor 6 senses a moisture content generated and laden in air discharged from the cooking cavity 2 to the outside during a cooking operation. The control unit 11 is also electrically connected at its output terminals to a plurality of drive units, that is, a magnetron drive unit 12*a*, a fan drive unit 12*b*, a motor drive unit 12*c*, and a display drive unit 12*d*. The magnetron drive unit 12*a*, fan drive unit 12*b*, motor drive unit 12*c*, and display drive unit 12*d* respectively drive the magnetron 3*a*, cooling fan 3*b*, tray motor 2*b*, and display unit 5*b* in response to corresponding control signals output from the control unit 11.

Where the control unit 11 starts a cooking operation of the microwave oven with food laid on the cooking tray 2*a* in the cooking cavity 2, in response to a user's input signals output from the input unit 5*a*, the control unit 11 outputs a control signal to the magnetron drive unit 12*a* so as to drive the magnetron 3*a*. In response, the magnetron 3*a* generates microwaves, and the microwaves are irradiated into the cooking cavity 2 to cook the food on the cooking tray 2*a*.

During such a cooking operation, the cooling fan 3*b* sucks atmospheric air into the machine room 3, and cools the electrical and electronic devices installed in the machine room 3. The inlet air in the machine room 3 also flows through the air inlet port 7*a* under the guide of the air guide duct 3*c*, and is introduced into the cooking cavity 2. The air in the cooking cavity 2 is discharged from the cooking cavity 2 to the outside through the air outlet port 8*a*, as shown by the arrows of FIG. 3. In such a case, moisture generated during the cooking operation in the cooking cavity 2 is discharged along with the air from the cooking cavity 2 to the outside through the air outlet port 8*a*. Therefore, it is possible to remove the moisture and odor from the cooking cavity 2 to the outside during the cooking operation. The discharged air laden with the moisture also passes through the humidity sensor 6. Accordingly, the humidity sensor 6 senses the humidity of the discharged air, and outputs a signal to the control unit 11. In response to the signal output from the humidity sensor 6, the control unit 11 performs the cooking operation of the microwave oven while appropriately controlling the magnetron 3*a*, tray motor 2*b* and cooling fan 3*b*.

Figure 5:
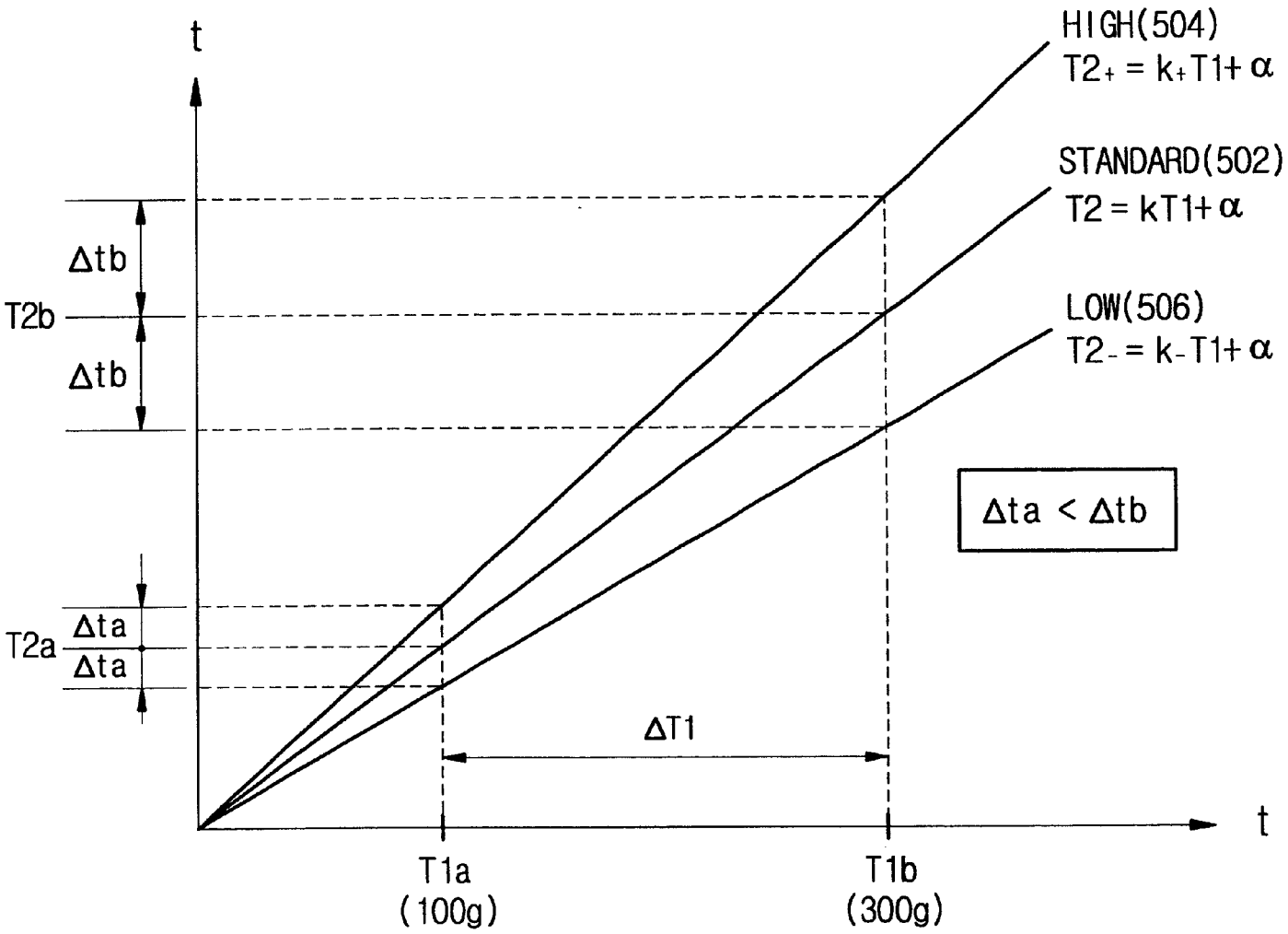
FIG. 5 is a graph showing an example of characteristic curves of three types of cooking modes selected by a user through a mode-selecting unit of the microwave oven shown in FIG. 3, in accordance with the present invention.

FIG. 5 shows a graph illustrating an example of characteristic curves of three types of cooking modes selected by a user through the mode-selecting unit 14 in accordance with the present invention. As shown in the drawing, during a cooking operation, the microwave oven of the present invention can be controlled in accordance with one of the three types of cooking modes, that is, a high mode 504 with a longer cooking time period, a standard mode 502 with a standard cooking time period, or a low mode 506 with a shorter cooking time period, which is selected by the user through the mode-selecting unit 14.

In the present invention, the characteristic curves of the three cooking modes 502, 504 and 506 have different slopes. Therefore, it is possible to adjust a second cooking time period T2 in accordance with the quantity of food. As shown in FIG. 5, the slope of the characteristic curve in the high mode 504 is sharper than that in the standard mode 502, while the slope of the characteristic curve in the low mode 506 is gentler than that in the standard mode 502. The characteristic curves of the three cooking modes 502, 504 and 506 meet each other at an origin (0,0).

As shown in the graph of FIG. 5, where it is desired to cook 100 g of food using the microwave oven, a variation Δta is available for a second cooking time period T2*a*. Where it is desired to cook 300 g of food using the microwave oven, a variation Δtb is available for a second cooking time period T2*b*.

In the case of the cooking of the 100 g of food, a first cooking time period T1 a is primarily determined in accordance with the quantity of the food. Thereafter, the second cooking time period T2*a* is determined in accordance with the first cooking time period T1*a*. Accordingly, a standard cooking time period for cooking the 100 g of food is determined as (T1*a*+T2*a*) by summing the first and second cooking time periods. Where a user manipulates the mode-selecting unit 14 to adjust a cooking time period in accordance with his/her taste, the standard cooking time period (T1*a*+T2*a*) for the 100 g of food may be lengthened or shortened by the variation Δta.

Where it is desired to cook the 300 g of food using the microwave oven, a first cooking time period T1*b* is primarily determined in accordance with the quantity of the food. Thereafter, the second cooking time period T2*b* is determined using the first cooking time period T1*b*. Therefore, a standard cooking time period for cooking the 300 g of food is determined as (T1*b*+T2*b*) by summing the first and second cooking time periods for the 300 g of food. Where a user manipulates the mode-selecting unit 14 to adjust the cooking time period in accordance with his/her taste, the standard cooking time period (T1*b*+T2*b*) for the 300 g of food may be lengthened or shortened by the variation Δtb.

Comparing the variations Δta and Δtb available for the two cooking operations, for the 100 g and 300 g of foods, it is noted that the variation Δtb is larger than the variation Δta. The relationships between the three cooking modes 502, 504 and 506 are further detailed below.

Where the characteristic curve of the standard mode 502, determined in accordance with the quantity of food to be cooked, is expressed as $T2=kT1+\alpha$, the characteristic curve of the high mode 504 is expressed as $T2_{+}=k_{+}T1+\alpha$. Similarly, the characteristic curve of the low mode 506 is expressed as $T2_{-}=k_{-}T1+\alpha$. In the above three expressions, the components k, $k_{+}$ and $k_{-}$ are proportional factors, which are determined in accordance with the kinds of foods to be cooked, and respectively denote the corresponding slopes of the characteristic curves of the three cooking modes 502, 504 and 506. The relationship between the three proportional factors is expressed by the inequality, $k_{-}<k<k_{+}$. Since the characteristic curves of the three cooking modes 502, 504 and 506 have different slopes, a cooking time period variation in the high or low mode 504 or 506 is changed in accordance with a variation in the first cooking time period T1. In the above three expressions, the component a is a constant which is determined to limit the range of the variable second cooking time T2.

In the case of the cooking of the 300 g of food using the microwave oven, the first cooking time period T1*b* is primarily determined in accordance with the quantity of the food, 300 g. Thereafter, the second cooking time period T2*b* is determined using the first cooking time period T1*b*. Therefore, the total standard cooking time period for cooking the 300 g of food is determined as (T1*b*+T2*b*) by summing the first and second cooking time periods for the 300 g of food. Where a user manipulates the mode-selecting unit 14 to adjust the cooking time period in accordance with his/her taste, the total cooking time period is lengthened or shortened to become T1*b*+T2*b*±Δtb by adding or subtracting the time period variation Δtb, which varies in accordance with the quantity of food (or the first cooking time period T1*b*), to or from the standard cooking time period T1*b*+T2*b*.

Figure 6:
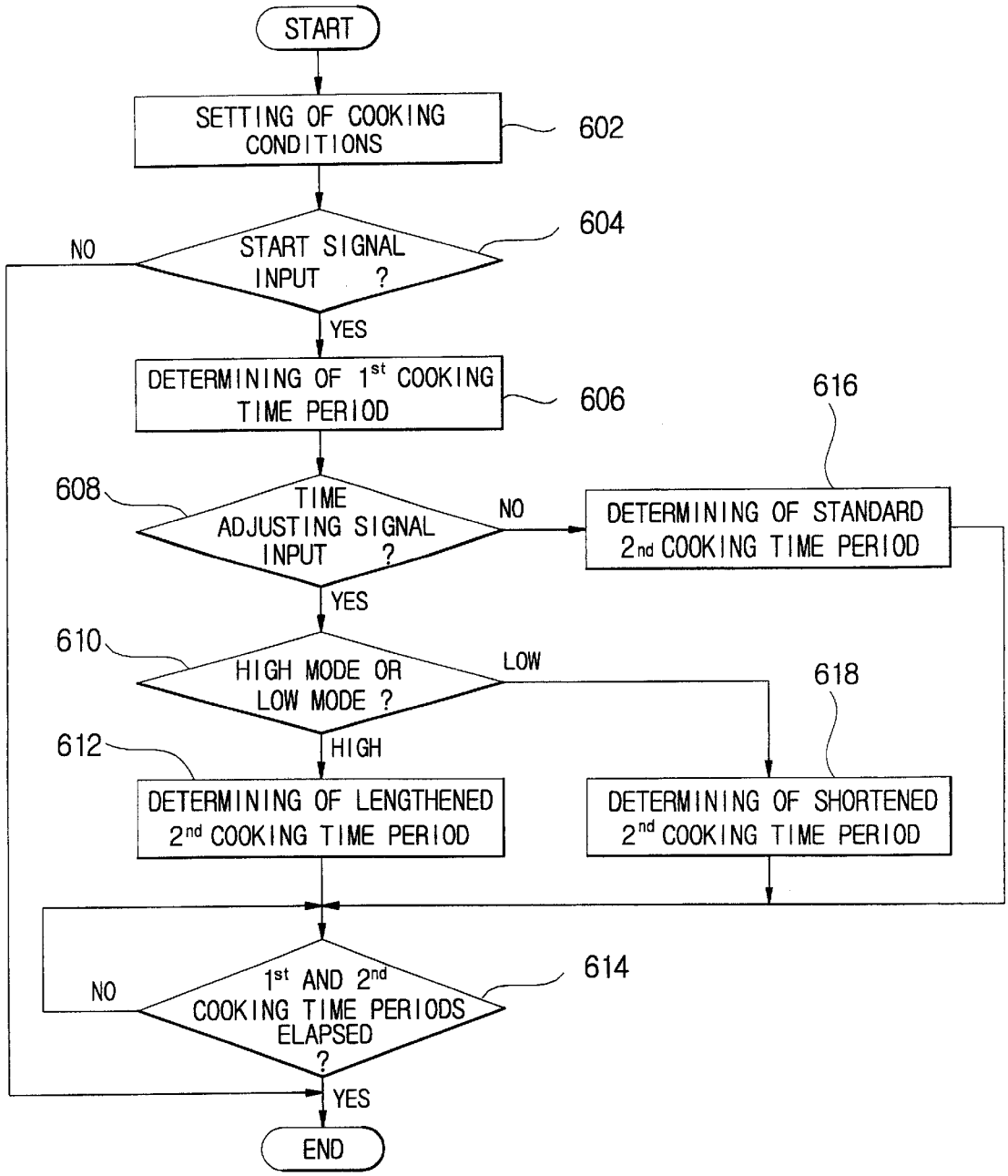
FIG. 6 is a flowchart of a method of controlling a cooking operation of the microwave oven shown in FIG. 3, in accordance with the present invention.

FIG. 6 shows a flowchart of a method of controlling a cooking operation of the microwave oven in accordance with the present invention. To cook food using the microwave oven of the present invention, a user lays food on the cooking tray 2*a* in the cooking cavity 2. Thereafter, the user sets one or more cooking conditions, such as the kind of food to be cooked, by manipulating the input unit 5*a* of the control panel 5 in operation 602. In such a case, the input unit 5*a* outputs a user's input signals to the control unit 11. Upon receiving the signals output from the input unit 5*a*, the control unit 11 determines whether a cooking start signal has been input in operation 604.

Where it is determined that the cooking start signal has been input, the control unit 11 outputs control signals to the magnetron drive unit 12*a* and the fan drive unit 12*b*, so as to drive the magnetron 3*a* and the cooling fan 3*b*. The control unit 11 also outputs a control signal to the motor drive unit 12*c*, so as to have the tray motor 2*b* rotate the cooking tray 2*a*. During the output operations, the control unit 11 determines a first cooking time period T1 in operation 606.

After starting the cooking operation of the microwave oven, in operation 608, the control unit 11 determines whether a cooking time adjusting signal has been input, indicating a user's manipulation of one of cooking time lengthening and shortening buttons of the mode-selecting unit 14 during the first cooking time period T1, so as to lengthen or shorten a total cooking time period. Where it is determined in the operation 608 that the cooking time adjusting signal has been input, the control unit 11 determines whether the cooking time adjusting signal is a high mode signal or a low mode signal in operation 610. Where it is determined in the operation 610 that the cooking time adjusting signal is the high mode signal, the control unit 11 determines a second cooking time period T2 in accordance with the first cooking time period T1 and factors preset in accordance with the kind of food to be cooked in operation 612. In such a case, the second cooking time period T2 is set to be longer than a standard second cooking time period, and a variation in the second cooking time period T2 is determined in proportion to a state of the food, such as the quantity of the food or the quantity of moisture laden in the food, or in proportion to the first cooking time period T1.

Where it is determined in the operation 610 that the cooking time adjusting signal is the low mode signal, the control unit 11 determines a second cooking time period T2 which is shorter than the standard second cooking time period in operation 618. In such a low mode, the second time period T2 is determined in the same manner as that described for the high mode. That is, the variation in the second cooking time period T2 is determined in proportion to the state of the food, such as the quantity of the food or the quantity of the moisture laden in the food, or in proportion to the first cooking time period T1.

Where it is determined in the operation 608 that no cooking time adjusting signal is input, the control unit 11 determines the standard second cooking time period T2 in operation 616.

After the determination of the lengthened, shortened or standard second cooking time period T2 in the corresponding operation 612, 616, or 618, the control unit 11 determines whether the first and second cooking time periods T1 and T2 have elapsed in operation 614. Where it is determined in the operation 614 that the first and second cooking time periods T1 and T2 have elapsed, the control unit 11 controls the magnetron drive unit 12*a*, the fan drive unit 12*b* and the motor drive unit 12*c* so as to stop the magnetron 3*a*, the cooling fan 3*b* and the tray motor 2*b*. Accordingly, the cooking operation is completed.

Figure 7:
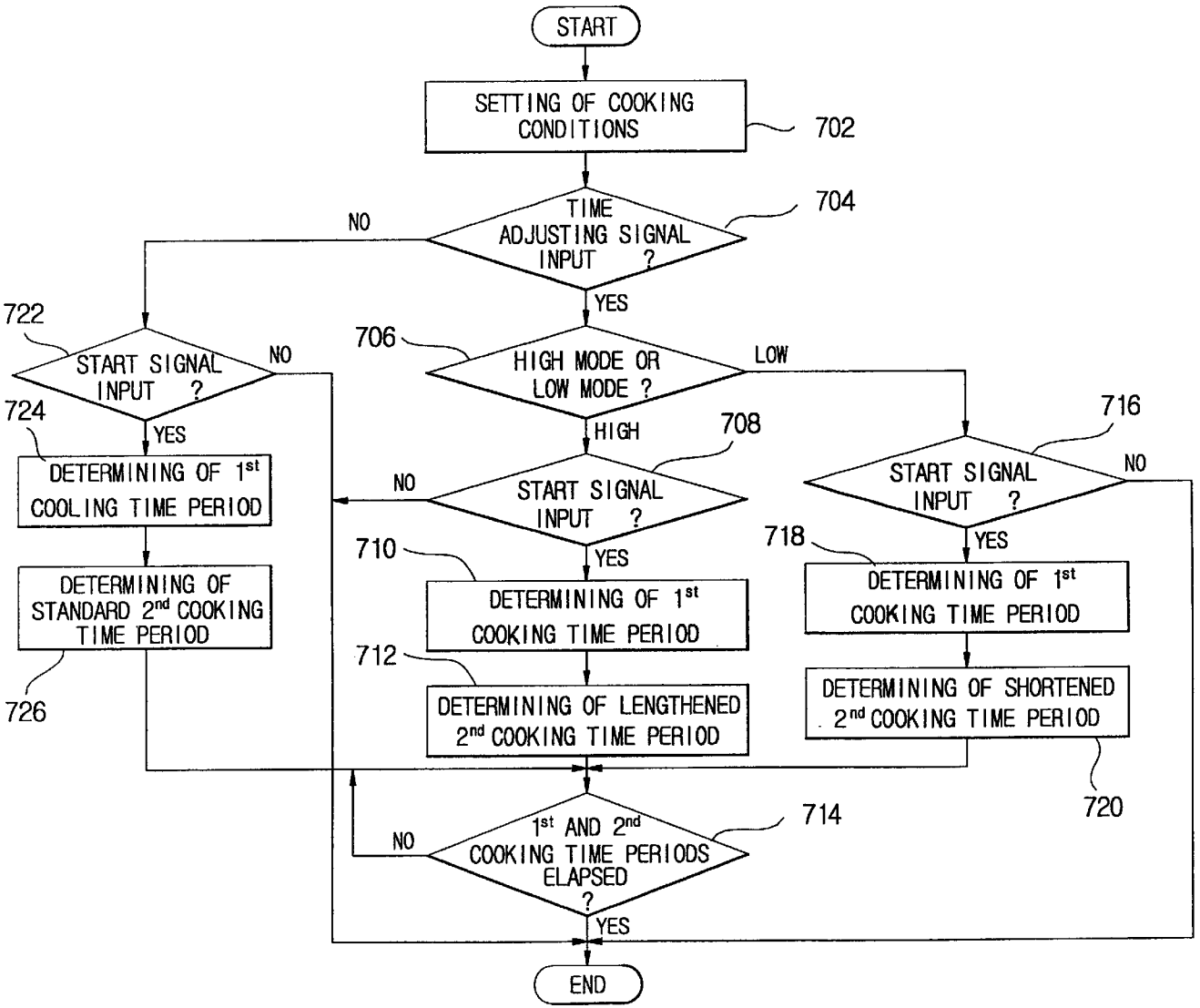
FIG. 7 is a flowchart of another method of controlling the cooking operation of the microwave oven shown in FIG. 3, in accordance with the present invention.

FIG. 7 shows a flowchart of another method of controlling a cooking operation of the present microwave oven. As shown in the drawing, a user may set one or more cooking conditions, such as the kind of food to be cooked, by manipulating the input unit 5*a* of the control panel 5 in operation 702. Thereafter, in operation 704, the control unit 11 determines whether a cooking time adjusting signal has been input, indicating a user's manipulation of one of the cooking time lengthening and shortening buttons of the mode-selecting unit 14 to lengthen or shorten the total cooking time period prior to starting the cooking operation.

Where it is determined in the operation 704 that the cooking time adjusting signal has been input, the control unit 11 determines whether the cooking time adjusting signal is a high mode signal or a low mode signal in operation 706. Where it is determined in the operation 706 that the cooking time adjusting signal is the high mode signal, the control unit 11 determines whether a cooking start signal has been input in operation 708. Where it is determined that the cooking start signal has been input, the control unit 11 determines a first cooking time period T1 in operation 710, and performs the cooking operation to cook the food. Thereafter, in operation 712, the control unit 11 determines a second cooking time period T2 in accordance with the first cooking time period T1 and factors preset in accordance with the kind of food to be cooked. In such a case, the second cooking time period T2 is longer than a standard second cooking time period, and a variation in the second cooking time period T2 is determined in proportion to a state of the food, such as the quantity of the food or the quantity of moisture laden in the food, or in proportion to the first cooking time period T1.

Where it is determined in the operation 706 that the cooking time adjusting signal is the low mode signal, the control unit 11 determines whether the cooking start signal has been input in operation 716. Where it is determined that the cooking start signal has been input, the control unit 11 determines a first cooking time period T1 in operation 718, and performs the cooking operation. Thereafter, in operation 720, the control unit 11 determines a second cooking time period T2, which is shorter than the standard second cooking time period. In such a low mode, the second time period T2 is determined in the same manner as that described for the high mode. That is, the variation in the second cooking time period T2 is determined in proportion to the state of the food, such as the quantity of the food or the quantity of the moisture laden in the food, or in proportion to the first cooking time period T1.

After the determination of the lengthened or shortened second cooking time period T2 in the operation 712 or 720, the control unit 11 outputs control signals to the magnetron drive unit 12*a* and the fan drive unit 12*b*, so as to drive the magnetron 3*a* and the cooling fan 3*b*. The control unit 11 also outputs a control signal to the motor drive unit 12*c*, so as to have the tray motor 2*b* rotate the cooking tray 2*a*.

Where it is determined in the operation 704 that no cooking time adjusting signal is input, the control unit 11 determines whether the cooking start signal has been input in operation 722. Where it is determined that the cooking start signal has been input, the control unit 11 determines a standard first cooking time period T1 in operation 724, and determines a standard second cooking time period T2 in operation 726.

During the cooking operation, after the determination of the lengthened, shortened or standard second cooking time period T2 in the corresponding operation 712, 720 or 726, the control unit 11 determines whether the first and second cooking time periods T1 and T2 have elapsed in operation 714. Where it is determined in the operation 714 that the first and second cooking time periods T1 and T2 have elapsed, the control unit 11 controls the magnetron drive unit 12*a*, the fan drive unit 12*b* and the motor drive unit 12*c* so as to stop the magnetron 3*a*, the cooling fan 3*b* and the tray motor 2*b*. Accordingly, the cooking operation is completed.

Figure 8:
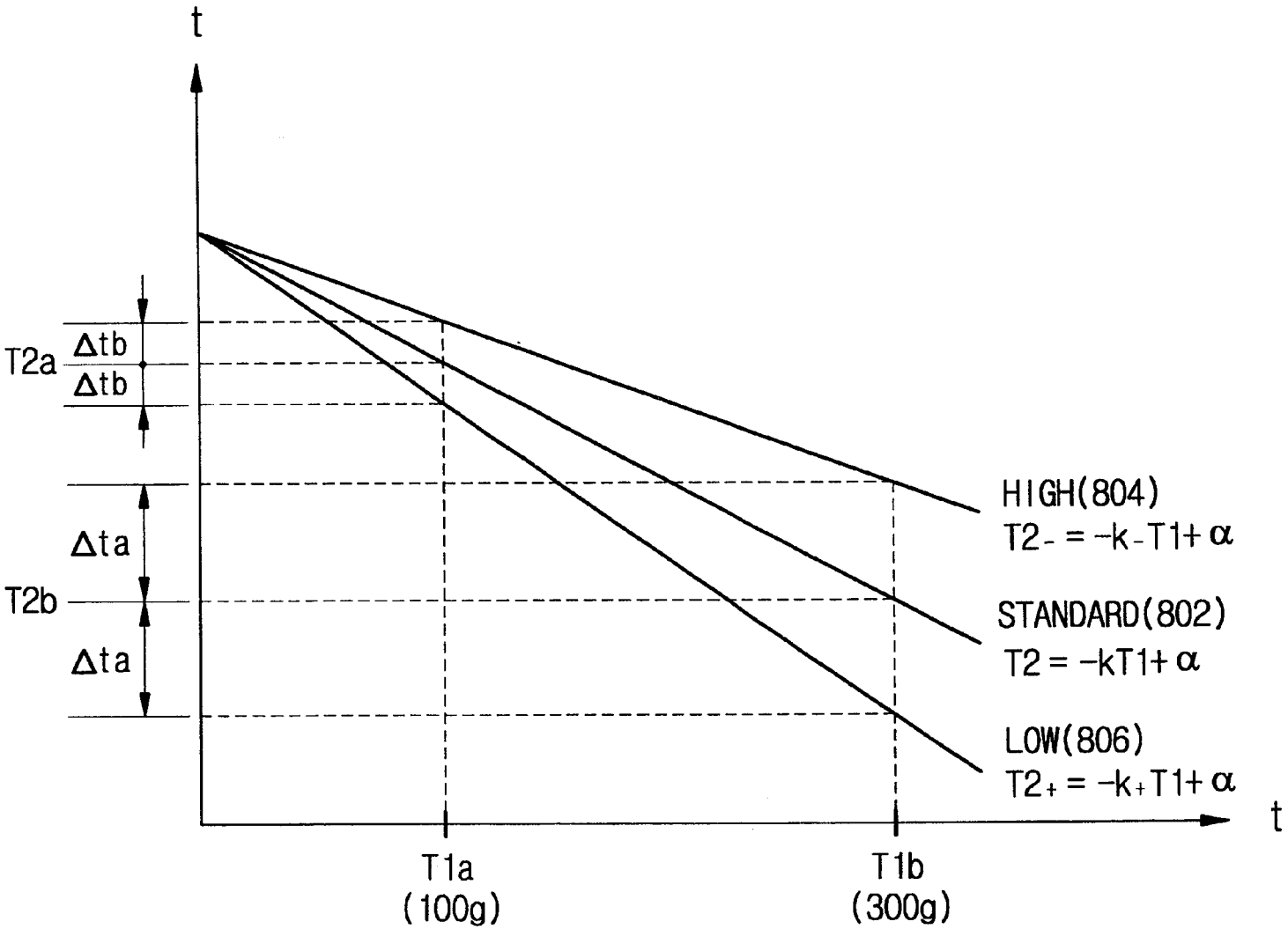
FIG. 8 is a graph showing another example of characteristic curves of the three types of the cooking modes selected by a user through the mode-selecting unit of the microwave oven shown in FIG. 3, in accordance with the present invention.

FIG. 8 shows a graph illustrating another example of the characteristic curves of the three types of cooking modes selected by a user through the mode-selecting unit 14 in accordance with the present invention. In each of the three cooking modes 802, 804 and 806 of FIG. 8, the second cooking time period T2 is determined in inverse proportion to the first cooking time period T1, and the slopes of the characteristic curves of the three modes have minus values. This means that as the first cooking time period T1 is lengthened, the second cooking time period T2 is shortened.

The cooking modes of FIG. 8 are used in, for example, cooking of dry foods, such as popcorn. Since such dry food has less moisture, it is almost impossible to measure the weight of the dry food by sensing the quantity of moisture laden in the dry food. In addition, such dry food is not required to be cooked for an extended period of time after most of the moisture laden in the dry food is vaporized, that is, at a time where the first cooking time period ends and the second cooking time period is initiated. Therefore, the second cooking time period T2 does not comprise a large portion in the total cooking time period. The slopes $k_+$, k and $k_-$ of the characteristic curves of the three cooking modes 802, 804 and 806 of FIG. 8 are minus values. Comparing the variations Δta and Δtb in the cooking time period for the two cooking operations having different quantities of foods, it is noted that the variation Δtb is larger than the variation Δta. The relationships between the three cooking modes 802, 804 and 806 are expressed in more detail as follows.

Where the characteristic curve of the standard mode 802, determined in accordance with the quantity of food to be cooked, is expressed as $T2=-kT1+\alpha$, the characteristic curve of the high mode 804 is expressed as $T2_{-}=-k_{-}T1+\alpha$. In the same manner, the characteristic curve of the low mode 806 is expressed as $T2_{+=-k+}T1+\alpha$. In the above three expressions, the components $-k$, $-k_{+}$ and $-k_{-}$ are proportional factors, which are determined in accordance with the kinds of foods to be cooked, and respectively denote the slopes of the characteristic curves of the three cooking modes 802, 804 and 806. The relationship between the three proportional factors is expressed by the inequality, $k_{-}<k<k_{+}$. Since the characteristic curves of the three cooking modes 802, 804 and 806 have different slopes, a cooking time period variation in the high or low mode 804 or 806 is changed in accordance with a variation in the first cooking time period T1. In the above three expressions, the component a is a constant which is determined to limit the range of the variable second cooking time T2.

Where the slopes of the characteristic curves of the three cooking modes 802, 804 and 806 are set to minus values as shown in FIG. 8, the concept of lengthening and shortening the cooking time period is overturned. That is, where a user selects a high mode through the mode-selecting unit 14, the second cooking time period T2 is shortened in accordance with the characteristics of dry food, such as popcorn. Where the user selects a low mode through the mode-selecting unit 14, the second cooking time period T2 is lengthened. That is, it is noted that the concept of the high or low mode selected through the mode-selecting unit 14 of this microwave oven does not simply mean a lengthening or shortening of the cooking time period. Rather, it is better considered as controlling a cooked state of food to make it well-done or rare (lesser-done) instead of medium-done.

As described above, the present invention provides a microwave oven which allows a user to set a cooking time period such that the cooking time period is controllably lengthened or shortened in proportion to the quantity of food. Since the present microwave oven appropriately lengthens or shortens the cooking time period based on the quantity of the food to be cooked, it can appropriately prepare the food to an individual's taste.

Although a few embodiments of the present invention have been shown and described, it will be appreciated by those skilled in the art that changes may be made in these embodiments without departing from the principles and spirit of the invention, the scope of which is defined in the appended claims and their equivalents.

What is claimed is:

1. A microwave oven which performs a cooking operation in one of cooking modes having a first cooking time period and a second cooking time period, comprising:

a cooking cavity; and a sensor which senses a state of air in the cooking cavity, wherein:

the first cooking time period is determined in accordance with an output value of the sensor, the second cooking time period is determined in accordance with the first cooking time period, wherein the first and second cooking time periods are expressed by a functional relation, and the cooking modes include a standard mode in which the second cooking time period is a standard second cooking time period, a high mode in which the second cooking time period is lengthened from the standard second cooking time period, and a low mode in which the second cooking time period is shortened from the standard second cooking time period, wherein:

the second cooking time period of the high mode is varied to increase in proportion to the first cooking time period; and the second cooking time period of the low mode is varied to increase in inverse proportion to the first cooking time period.

2. The microwave oven according to claim 1, wherein:

the standard mode satisfies the relationship $T2=kT1+\alpha$, the high mode satisfies the relationship: $T2_{+}=k_{+}T1+\alpha$, and the low mode satisfies the relationship: $T2_{-}=k_{-}T1+\alpha$, where T1 is the first cooking time period, T2 is the standard second cooking time period, $T2_{+}$ is a lengthened second cooking time period, $T2_{-}$ is a shortened second cooking time period, k, $k_{+}$ and $k_{-}$ are proportional factors expressed by an inequality, $k_{-}<k<k_{+}$, and $\alpha$ a is a constant.

3. The microwave oven according to claim 1, wherein:

the standard mode satisfies the relationship $T2=-kT1+\alpha$, the high mode satisfies the relationship $T2_{-}=-k_{-}T1+\alpha$, and the low mode satisfies the relationship $T2_{+}=-k_{+}T1+\alpha$, where T1 is the first cooking time period, T2 is the standard second cooking time period, $T2_{+}$ is a lengthened second cooking time period, $T2_{-}$ is a shortened second cooking time period, k, $k_{+}$ and $k_{-}$ are proportional factors expressed by an inequality, $k_{-}<k<k_{+}$, and $\alpha$ is a constant.

4. The microwave oven according to claim 1, wherein the sensor is a humidity sensor.

5. The microwave oven according to claim 1, wherein the sensor is a gas sensor.

6. The microwave oven according to claim 1, further comprising a mode-selecting unit which allows for selecting a desired one of the cooking modes.

7. The microwave oven according to claim 1, wherein the state of the air in the cooking cavity corresponds to a quantity of food contained in the cooking cavity.

8. The microwave oven according to claim 1, wherein the cooking modes are represented with corresponding characteristic curves having different slopes.

9. The microwave oven according to claim 1, further comprising:

a magnetron which generate electromagnetic waves to cook food;

a cooling fan which cools an interior of the microwave oven;

a cooking tray to receive the food thereon;

a display unit which displays cooking information;

a control unit which controls cooking operations of the microwave oven; and a data storage unit which communicates with the display unit and stores data of standard cooking time periods corresponding to types and quantities of foods to be cooked.

10. The microwave oven according to claim 9, wherein the control unit comprises:

an input unit which transmits input signals to operate the microwave oven to the control unit, and includes a mode-selecting unit which allows for selecting a desired one of the cooking modes;

a magnetron drive unit which drives the magnetron;

a fan drive unit which drives the cooling fan;

a motor drive unit which drives the cooking tray; and a display drive unit which drives the display unit.

11. A cooking apparatus which performs a cooking operation having first and second cooking time periods, comprising:

a heating unit to cook food contained in the cooking apparatus; and a control unit which selectively lengthens/shortens the second cooking time period in accordance with a variation in the first cooking time period in response to inputting of a mode-selection signal, wherein:

the first cooking time period is determined according to one of a quantity of food and a quantity of moisture laden in the food contained in the cooking apparatus, and the second cooking time period is determined in accordance with the first cooking time period.

12. The cooking apparatus according to claim 11, further comprising a sensor which senses a state of air in the cooking apparatus to determine the quantity of the food.

13. The cooking apparatus according to claim 11, wherein the cooking operation includes:

a standard mode in which the second cooking time period is unchanged and set as a standard second cooking time period;

a high mode in which the second cooking time period is lengthened from the standard second cooking time period; and a low mode in which the second cooking time period is shortened from the standard second cooking time period.

14. The cooking apparatus according to claim 13, further comprising a mode-selecting unit which allows for selecting a desired one of the cooking modes.

15. The cooking apparatus according to claim 11, wherein the cooking operation includes:

a standard mode which satisfies the relationship $T2=kT1+\alpha$, a high mode which satisfies the relationship: $T2_+=k_+T1+\alpha$, and a low mode which satisfies the relationship: $T2_-=k_-T1+\alpha$, where T1 is the first cooking time period, T2 is the second cooking time period, $T2_+$ is a lengthened second cooking time period, $T2_-$ is a shortened second cooking time period, k, $k_+$ and $k_-$ are proportional factors expressed by an inequality, $k_-<k<k_+$, and $\alpha$ is a constant.

16. The cooking apparatus according to claim 11, wherein the cooking operation includes:

a standard mode which satisfies the relationship $T2=-kT1+\alpha$, a high mode which satisfies the relationship $T2_-=-k_-T1+\alpha$, and a low mode which satisfies the relationship $T2_+=-k_+T1+\alpha$, where T1 is the first cooking time period, T2 is the second cooking time period, $T2_+$ is a lengthened second cooking time period, $T2_-$ is a shortened second cooking time period, k, $k_+$ and $k_-$ are proportional factors expressed by an inequality, $k_-<k<k_+$, and $\alpha$ is a constant.

17. A method of controlling a cooking operation of a cooking apparatus, the method comprising:

starting the cooking operation to cook food in response to inputting of a start signal;

determining a first cooking time period of the cooking operation according to one of a quantity of the food and a quantity of moisture laden in the food contained in the cooking apparatus;

determining a second cooking time period of the cooking operation in accordance with the first cooking time period; lengthening/shortening the second cooking time period in accordance with a variation in the first cooking time period in response to inputting of a time adjusting signal to adjust the second cooking time period; and stopping the cooking operation to cook the food in response to elapse of the first and second cooking time periods.

18. The method according to claim 17, further comprising determining whether the time adjusting signal is input during the cooking operation for the first cooking time period.

19. The method according to claim 17, further comprising determining whether the time adjusting signal is input prior to the starting of the cooking operation to cook the food.

20. The method according to claim 17, wherein the lengthening/shortening of the second cooking time period comprises:

determining whether the time adjusting signal is one of a high mode signal and a low mode signal to adjust the second cooking time period; and lengthening the second cooking time period in accordance with the variation in the first cooking time period in response the time adjusting signal being the high mode signal and shortening the second cooking time period in accordance with the variation in the first cooking time period in response the time adjusting signal being the low mode signal.

* * * * *